United States Patent [19]

Mill et al.

[11] 4,179,611

[45] Dec. 18, 1979

[54] EFFICIENCY MONITORING DEVICE

[75] Inventors: Kenneth G. Mill, 21 Hayward Dr., Galashiels, Scotland; Christian P. Lynch, Portbello, Scotland; Richard T. Strathie; Alexander F. H. Dixon, both of Tweedbank, Scotland

[73] Assignee: Kenneth G. Mill, Scotland

[21] Appl. No.: 870,422

[22] Filed: Jan. 18, 1978

[51] Int. Cl.[2] ..... G07C 3/10

[52] U.S. Cl. ..... 235/92 QC; 235/92 PD; 235/92 TF

[58] Field of Search ..... 235/92 QC, 92 PD, 92 TF, 235/92 V, 92 DE, 92 DM, 92 CP; 364/551, 552

[56] References Cited

U.S. PATENT DOCUMENTS

| | | | |
|---|---|---|---|
| 2,679,355 | 5/1954 | Savino | 235/92 QC |
| 2,730,300 | 1/1956 | Savino | 235/92 QC |
| 3,003,687 | 10/1961 | Bell | 235/92 PD |
| 3,242,320 | 3/1966 | Stout | 235/92 PD |
| 3,321,704 | 5/1967 | Mann | 235/92 PD |
| 3,720,815 | 3/1973 | Lorenzen | 235/92 PD |
| 3,809,869 | 5/1974 | Gebald | 235/92 PD |
| 3,832,531 | 8/1974 | Neill et al. | 235/92 PD |

*Primary Examiner*—Joseph M. Thesz

*Attorney, Agent, or Firm*—Prutzman, Kalb, Chilton & Alix

[57] ABSTRACT

The invention relates to a self-contained piece of electronic equipment for monitoring the progress of a processing operation (e.g. production from a machine) and in its preferred embodiments gives digital displays of achievement and target counts for the monitored operation as well as a constantly updated performance rating based on a ratio of true achievement.

4 Claims, 4 Drawing Figures

EFFICIENCY MONITORING DEVICE

This invention relates to a simple piece of self-contained, free standing equipment which is capable of giving a visual display of the efficiency of a wide range of different processing operations.

In many commercial operations it would be helpful to know, at any instant, the precise efficiency which has then being attained for that operation. Such information would enable early diagnosis of malfunctioning, would permit operators and/or managers to see how the operation is proceeding (and for operators on piece-rate or bonus working rates, what their likely earnings will be) and would generally improve the degree of control which can be exercised over that particular operation.

At the present time simple equipment which can be used with a wide variety of different processing apparatus is not available and this invention seeks to provide such equipment.

It has been proposed (in U.K. Pat. No. 1,354,184) to provide a tobacco processing or packing machine with sensors linked to a computing circuit and to provide visual displays of inter alia the proportion of reject products produced, the efficiency of production of products by the machine, the total output of products in a stated period and the maximum production achievable. However, the computing equipment provided in U.K. Pat. No. 1,354,184 adds considerably to the cost of the machine and since it is an integral part of the machine cannot be used with other machines operating in different manners.

It has also been proposed (in U.K. Pat. No. 1,493,741) to provide equipment which can be used with a range of different machines to indicate at any instant the output from the machine and further to give a warning if the machine is working too slowly (for efficient production) or too quickly (for acceptable machine life). The equipment described does not however provide a visual display of the overall efficiency of working of the machine, merely indicating when that efficiency is outside preset limits, and thus fails to give the vital information needed for optimum control of the monitored machine.

U.K. Pat. No. 1,493,741 discloses equipment for use with liquid processing plant to give instantaneous readings of the gain or loss experienced during chemical processing and thereby to permit the operating parameters of the process plant to be adjusted as soon as such adjustment becomes necessary. The equipment described is for a large scale chemical processing plant and is not suitable for general use and further does not provide the full range of information necessary to assess the performance of any one of a wide range of different processing apparatus.

According to the present invention monitoring equipment for use in a processing operation to indicate the efficiency of the operation in achieving a desired processing rate comprises, in combination, a housing, electronic clocking means within the housing to generate timing pulses, a presettable control within the housing to determine the rate at which pulses are fed from the clocking means to a computing circuit as a first signal, input terminals to the housing connected to the computing circuit to which input terminals can be attached a sensing means associated with the processing operation and which generates pulses (a second signal) at a rate indicative of the performance of the operation in processing, the computing circuit optionally including means to generate a third signal which represents a ratio of the first and second signals and including at least one visual display device on the housing on which a cumulative count of the first or second signals or periodically updated values of the third signal can be displayed.

Preferably the presettable control includes a series of thumb wheels which can be easily set to indicate a required repetition rate for the first signal. Suitably the thumb wheels are mounted where they can be accessible from outside the housing and conveniently a selector switch is provided (also on the outside of the housing) to permit the rate set on the thumb wheels to be either a rate per minute or a rate per hour. A clocking means based on an electronic treatment of mains frequency is preferred.

Suitably, when provided, the third signal represents percentage efficiency and is conveniently displayed as four digits. In a simple embodiment of the invention only the second and first signals are displayed digitally and the circuitry needed to generate the third signal is not provided. In another embodiment just the third signal is displayed while in a more sophisticated arrangement, the housing includes three visual display devices, one for each of the first, second and third signals.

Suitably the housing supports a readily accessible "reset" control (to enable the or each visual display device to be reset to zero) and optionally also a "hold" control which acts to interrupt the feeding of pulses from the clocking means to the computing circuit.

The housing can also include terminals from which signals indicative of the first, second and/or third signals can be obtained for supply to a remote monitoring location (e.g. a central supervising station) and suitably only optical interconnections are used between the terminals and the computing circuit within the housing.

Three embodiments of monitoring equipment in accordance with the invention will now be described, by way of example, with reference to the accompanying drawings, in which FIG. 1 is a perspective view of the first embodiment of equipment, FIG. 2 is a circuit diagram showing the computing circuit employed in the equipment of FIG. 1, FIG. 3 is a perspective view of a second embodiment of equipment, and FIG. 4 is a perspective view of a third embodiment of equipment.

The equipment shown in FIG. 1 comprises a housing 1 bearing on its front face 2, three four-digit displays 3, 4 and 5 and a bank of three adjacent thumb wheels 6. On the rear face of the housing (not shown) there is provided four switches and a terminal strip for the connection to the equipment of leads (from a processing apparatus with which it is to be used) carrying input signals and output leads to remote display equipment. The four switches are an on/off mains switch, a reset switch, a "run"/"hold" selector switch and a rate selector switch.

The equipment can be used with a wide range of different types of industrial apparatus but for the purposes of explanation of its mode of operation will be considered in association with a semi-automatic press tool machine which includes a sensor on the machine (e.g. a solid state switch, proximity detector or photoelectric cell) to indicate, by means of an electric pulse, each time a press operation is completed. The machine sensor would be wired to the equipment shown in FIG. 1 via the appropriate connections on the terminal strip.

The rate selector switch is set to the appropriate range (counts/minute or counts/hour) and the thumb wheels 6 are dialled to give the target production rate which management and workers have agreed is appropriate for the press tool machine under consideration. For the sake of example this will be chosen to be 123 articles/hour and this would involve setting the thumb wheels 6 to "123" and the rate selector switch to the "counts"/"hour" setting.

When the equipment is connected to a 50 Hz mains supply, the on/off switch turned to the on position, and the run/hold switch in the "run" position, the equipment now starts counting and advances the display 4 "Target Count" by one digit every 0.4878 minutes (60/123 minutes). Each time the press tool machine is operated, the pulse generated by the sensor advances the display 3 "Achievement Count" by one digit. Periodically (e.g. every second) the ratio Achievement Count/Target Count×100 is calculated and this is represented on display 5 "Achievement %".

If we assume the press tool machine is being operated at exactly the target rate, the displays 3 and 4 will keep in step with each other throughout the working shift and the display 5 will generally be recording "100%". Should the press tool machine operate at a faster rate than the target rate, the read-out on display 3 will be greater than that on display 4 and display 5 will show an efficiency in excess of "100%". Conversely if the press tool machine operates at a slower rate than the target rate, display 4 will exceed display 3 and display 5 will be less than 100%. Thus at any instant during a work shift the performance of the machine can be instantly assessed.

If the shift includes rest periods in which the machine is not required to work, the run/hold selector switch can be set in the "hold" position and this has the effect of stopping further advance of the "Target Count" until the switch is returned to the "run" position. Should the operators of the machine be on a piece-rate or bonus payment scheme they can continue to advance the "Achievement Count" during a rest period and thereby improve on their score on display 5. When a particular monitoring period has concluded, the displays 3, 4 and 5 can all be returned to zero by momentarily operating the reset switch.

The electronic circuitry which causes the equipment shown in FIG. 1 to operate in the described manner can be seen from FIG. 2. In FIG. 2 the sensor from the press tool machine is shown at 16, the run/hold switch at 8, the rate selector switch at 11 and the reset switch at 25. The displays 3, 4 and 5 are shown as they appear in FIG. 1 and the thumb wheels are indicated by the box 6.

The power supply unit 10 is a full wave rectifier, including smoothing and voltage stabilizing units and feeds power to a 50/60 Hz converter 12 formed of a pair of 4011 NAND gates linked in a S/R latch configuration.

A phase comparator 13 (Motorola 4046), a low pass filter 14, a voltage controlled oscillator 15 (a 4046) and a programmable frequency divider 17 (three 4029s) form a phase locked loop to which the outputs of the three thumb wheels 6 are fed. Each thumb wheel is a proprietary item having a four wire output and providing a logic one signal in binary coding on the appropriate one or ones of the four wires corresponding to the digital number set on the thumb wheel.

The run/hold switch 8 is connected to a pair of 4093 NAND gates forming a control gate 19 and then optionally through a 1/60th frequency divider 20 (a 4024), depending on the setting of the switch 11, to a frequency divider 21 (a 4040) dividing by 3000 in the case of 50 Hz input or 3600 in the case of 60 Hz input. The output of the divider 21 is fed directly to a 74C925 forming the driver unit for a pair of twin 7 segment 6740 LED's which represents the display 4. The display 4 thus gives a cumulative count derived from multiplying the mains frequency by the rate set on the thumb switches in the block 6, dividing by 3000 (or 3600) and if counts/hour has been selected also by 60. The switch 8 allows the display on 4 to be held or advanced at the appropriate rate. The switch 11 allows the block 20 to be included or by-passed and thus selects a rate/hour or a rate/minute.

The machine sensor 16 is connected via a buffer amplifier 26 (a 4093) to a 74C25 driver unit for a second pair of twin 7 segment 6740 LED's forming the display 3. Thus each time a logic one signal appears on the input to the amplifier 26 the count on the display 3 is advanced by one.

The signal train a fed to the driver unit of the display 4 and the signal train b fed to the driver unit of the display 3 are processed in a ratio circuit shown within the dashed line box in the left-hand corner of FIG. 2. The signal a is supplied to a programmable frequency divider 27 which comprises two series-connected 4518 dual BCD counters (handling, respectively, the units, tens, hundreds and thousands) feeding four 4029 programmable up/down counters via four 4042 four-bit latches.

The signal train b is supplied to a rate multiplier circuit 28 comprising two series-connected 4518 dual BCD counters feeding four 4527 up/down counters via four 4042 four-bit latches. The frequency of operation of the rate multiplier 28 is set by an oscillator 29 comprising a series-connected pair of 4001 NOR gates.

The output from the rate multiplier 28 is fed to a frequency divide circuit 32 where a 4024 is used to produce one output for each one hundred inputs received.

The outputs from the frequency dividers 27 and 32 are combined in a control gate 33 (comprising a pair of 4011 NAND gates) and fed to the driver unit of the third display 5.

The reset switch 25 acts simultaneously to clear the memories of units 20, 21, 27 and 28 and to restore the displays 3 and 4 to zero.

Three outputs 4', 3' and 25' are provided for connecting the unit of FIG. 1 to a remote monitoring location, these outputs producing logic signals corresponding to the outputs a and b and when the reset switch 25 is operated. To ensure that connections to the outputs 4', 3' and 25' cannot affect the circuit within the housing 1, the circuitry includes 75492 buffer amplifiers feeding LED's each LED being linked optically to a photosensitive transistor in the output connection. A remote connection for the output of control gate 33 (to drive a remote percentage achievement display) can also be provided although this has not been illustrated in FIG. 2.

Figure 1:
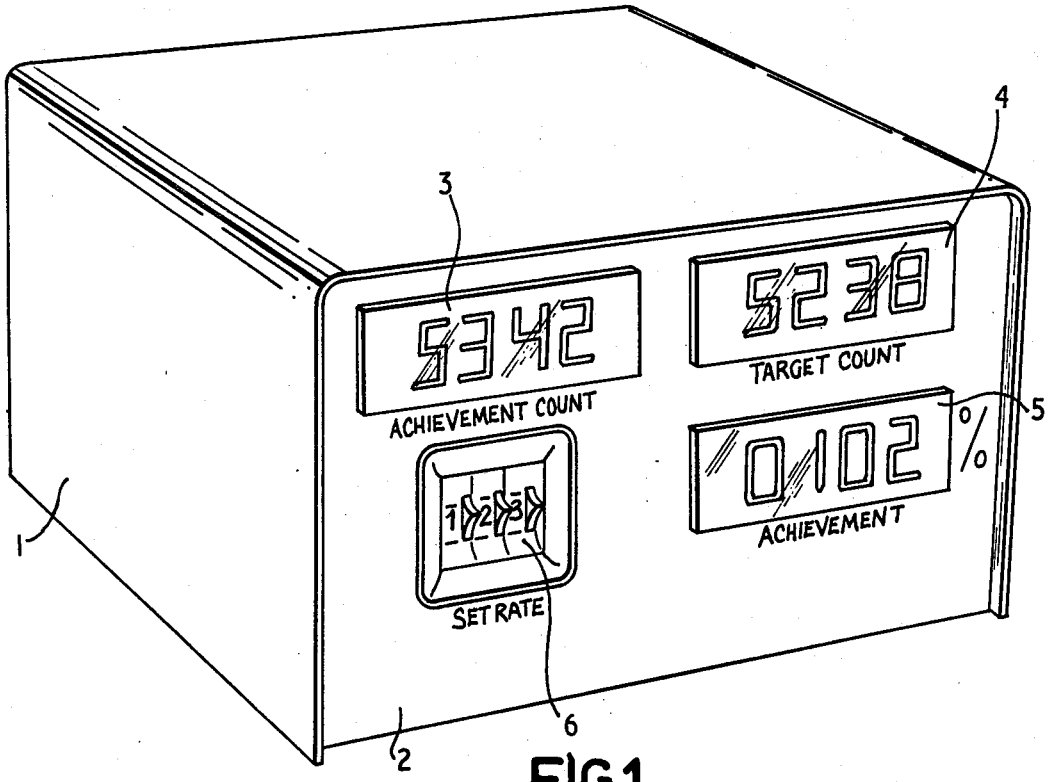
Figure 3:
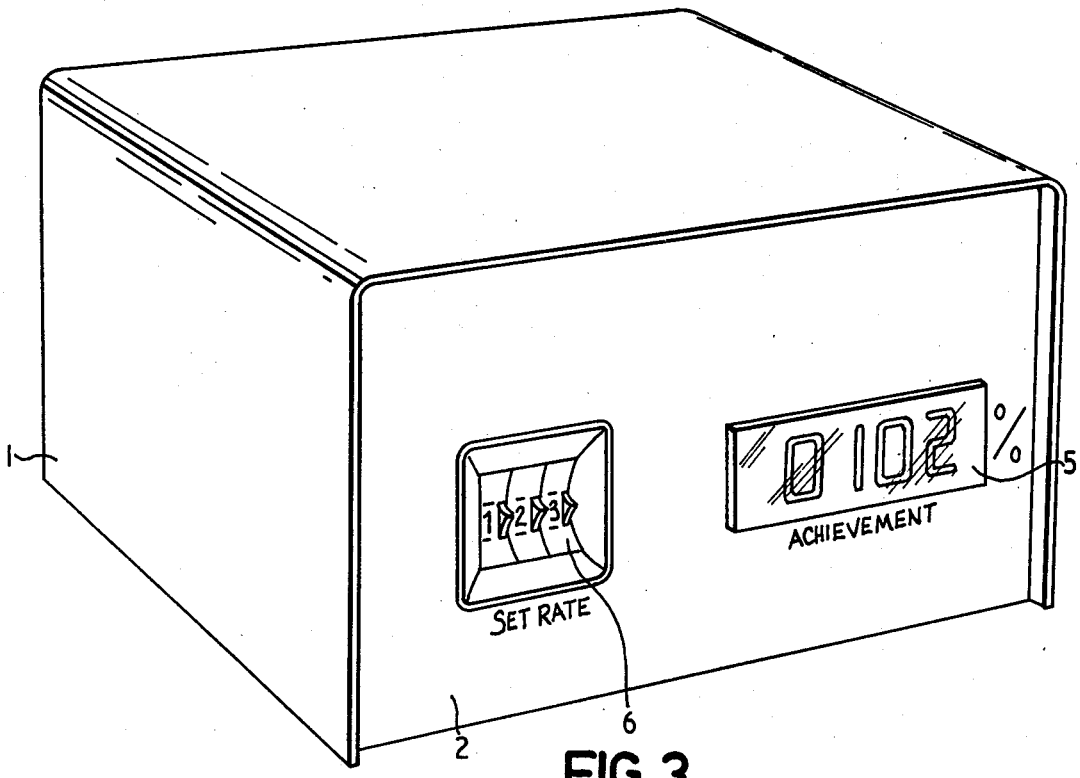
FIG. 3 shows a modified embodiment of monitoring equipment in which the displays 3 and 4 are dispensed with, but the circuit of FIG. 2 is otherwise exactly as described above.
Figure 2:
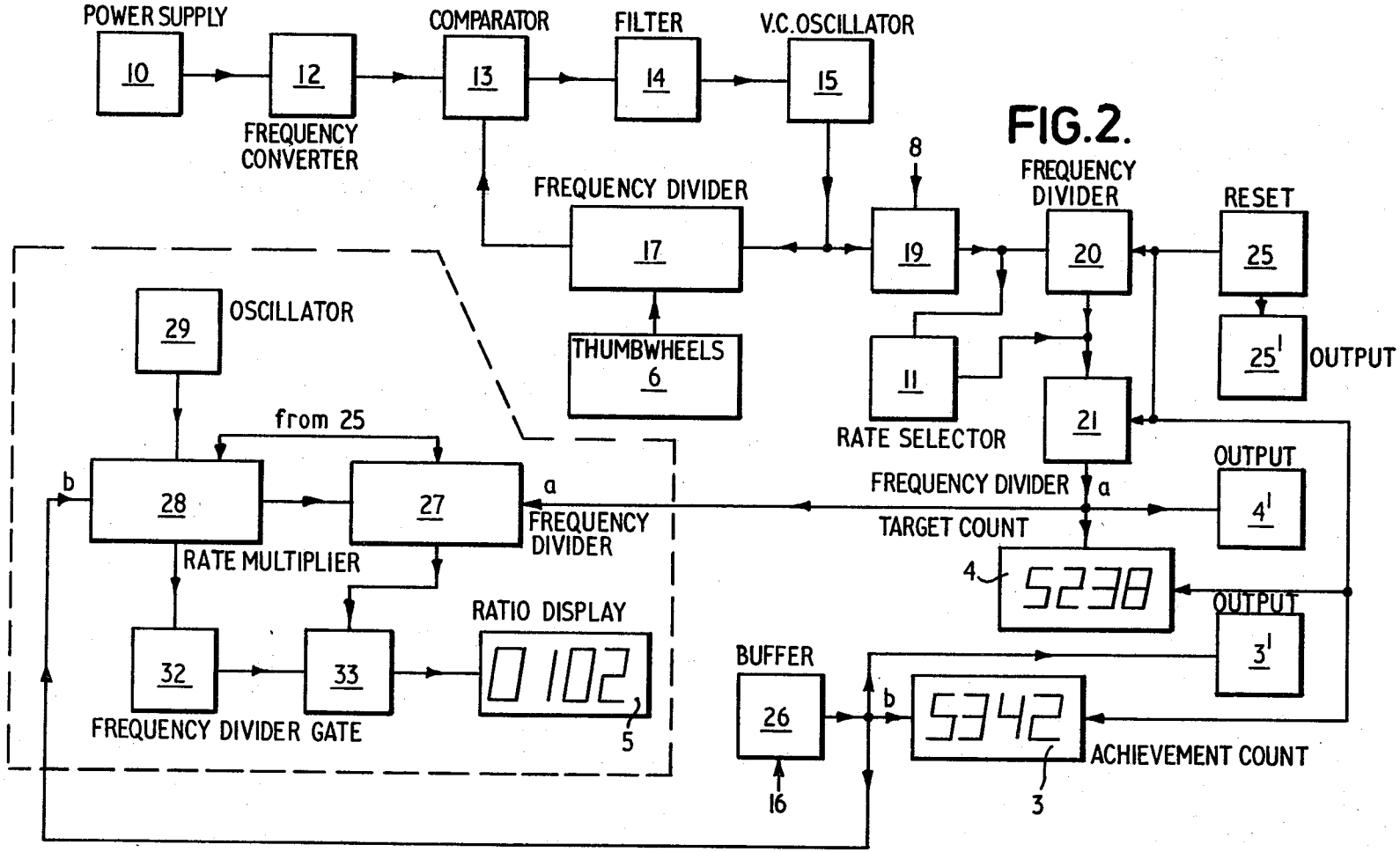
Figure 4:
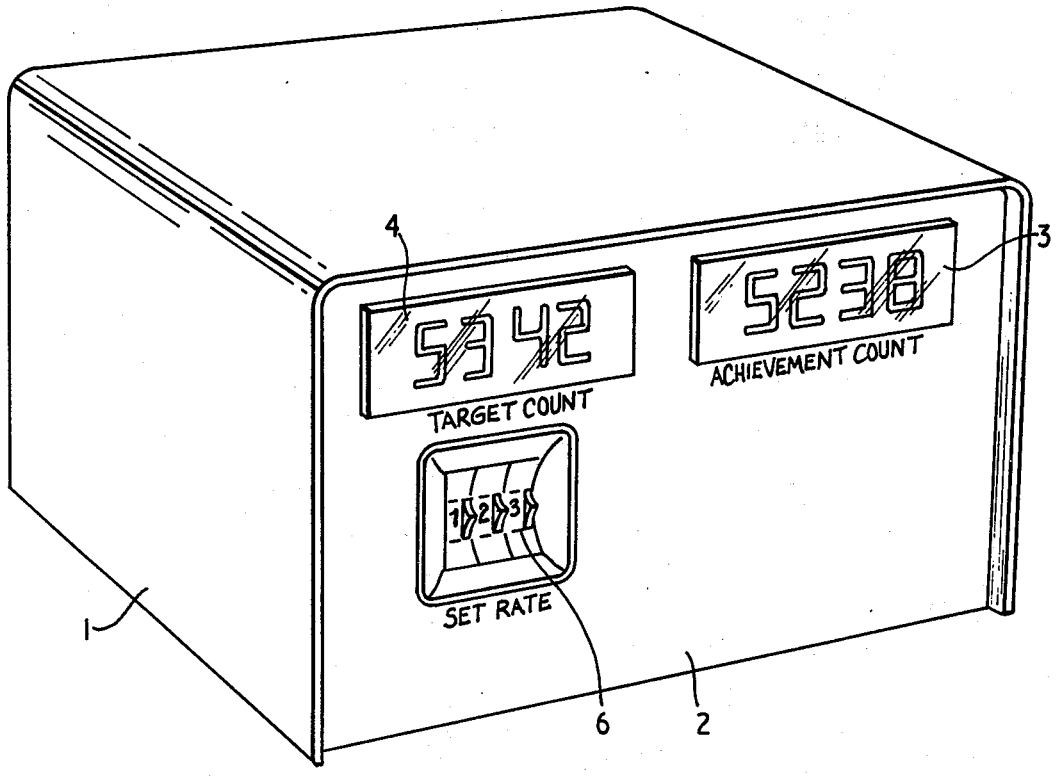
FIG. 4 shows a simple embodiment in which the ratio circuit (shown in the dashed box in FIG. 2) is not provided, the equipment only displaying the target and achievement counts.

Although the specific description has referred to the equipment being used with a semi-automatic press tool machine, it should be clearly understood that it is applicable to a wide range of different operational apparatus and even has potential to non-apparatus production operations (such as packing biscuits or bottles). The target output in such cases can be calculated by reference to agreed work measurement standards laid down by the International Labour Office (ILO) in Geneva.

The free-standing self-contained nature of the equipment described makes it easily transferable between different operations as need arises.

What is claimed is:

1. Monitoring equipment for use with a processing machine to indicate the efficiency of the machine in achieving a desired processing rate comprising, in combination, a housing remote from the machine, electronic clocking means within the housing to generate timing pulses, a presettable control with the housing to determine the rate at which pulses are fed from the clocking means to a computing circuit as a first signal, the presettable control including a manually settable device on which the repetition rate for the first signal can be set digitally, input terminals to the housing connected to the computing circuit to which input terminals can be attached a sensing means associated with the processing machine and which generates second signal pulses at a rate indicative of the performance of the machine in processing, the computing circuit including means to generate a third signal which represents a ratio of the first and second signals and including digital display devices on the housing on which, respectively, a cumulative count of the first and second signals and periodically updated values of the third signal are displayed.

2. Monitoring equipment as claimed in claim 1, in which the housing supports a manual "reset" control to reset each digital display to zero.

3. Monitoring equipment as claimed in claim 1, in which the housing supports a manual "hold" control which acts to interrupt the feeding of pulses from the clocking means to the computing circuit.

4. Monitoring equipment as claimed in claim 1, in which the housing supports a rate selector switch settable in two positions, one for rates per hour and the other for rates per minute.

* * * * *